United States Patent [19]

Dilg et al.

[11] 4,064,998

[45] Dec. 27, 1977

[54] RAILWAY COUPLER AND DRAFT RIGGING

[75] Inventors: Walter C. Dilg, Elma; Wilbert G. Glauser, Alden, both of N.Y.

[73] Assignee: Dresser Industries, Inc., Dallas, Tex.

[21] Appl. No.: 627,638

[22] Filed: Oct. 31, 1975

[51] Int. Cl.[2] ..... B61G 9/00

[52] U.S. Cl. ..... 213/69; 213/62 R; 213/12

[58] Field of Search ..... 213/64, 71, 12, 18, 213/13, 14, 62, 63, 67, 69, 1 A, 9; 280/450, 451

[56] References Cited

U.S. PATENT DOCUMENTS

| | | | |
|---|---|---|---|
| 436,336 | 9/1890 | Chesnut | 213/104 |
| 1,412,834 | 4/1922 | Bleoo | 213/18 |
| 1,917,876 | 7/1933 | Dendler | 213/9 |
| 3,515,288 | 6/1970 | Frill et al. | 213/64 |
| 3,610,434 | 10/1971 | Herbert | 213/62 R |
| 3,750,896 | 8/1973 | Jeffrey | 213/12 |

*Primary Examiner*—Robert B. Reeves
*Assistant Examiner*—H. Grant Skaggs
*Attorney, Agent, or Firm*—Raymond T. Majesko; John N. Hazelwood

[57] ABSTRACT

The invention relates to a rapid transit draft rigging for an automatic coupler wherein a draft gear cushioning device is held within a pocket of a housing exterior to a drawbar that will release by a predetermined force to provide long free travel, permitting the coupler and draft gear arrangement to move out of the way so that they are not damaged by an accident that deforms the end of the car.

8 Claims, 3 Drawing Figures

RAILWAY COUPLER AND DRAFT RIGGING

BACKGROUND OF THE INVENTION

In subway and other railway cars, buffing and draft forces between connected or coupled cars normally are transmitted to the underframes of the cars through draft gears or other suitable cushioning devices contained in their draft rigging. However, particularly in the case of subway cars, it is desirable that the draft riggings and underframes be protected from damage by abnormal buffing forces, such as experienced in collisions, by causing such forces to be transmitted directly between the bodies of the cars. This has been accomplished in the past by providing one or each of the connected cars with a releasing draft rigging within the drawbar which, while enabling the car bodies normally to be spaced by their couplers or other connecting means, will release under buffing forces above a pre-determined level and by telescoping of the connecting means into one or either car, to produce direct contact between the adjourning ends of the car bodies.

An object of the present invention is to provide an improved releasing draft rigging which not only releases under abnormal buffing forces but is readily restorable to its initial condition.

Another object of the invention is to provide a draft rigging wherein the draft gear housing is positioned on a drawbar by shear bolts or pins designed to release at a desired force level in such a manner that the draft gear housing and coupler assembly slides on the drawbar after the release bolts shear so that long travel is provided to protect them from damage.

Other objects and advantages of the invention will be apparent from the following detailed description and drawings, in which.

Figure 1:
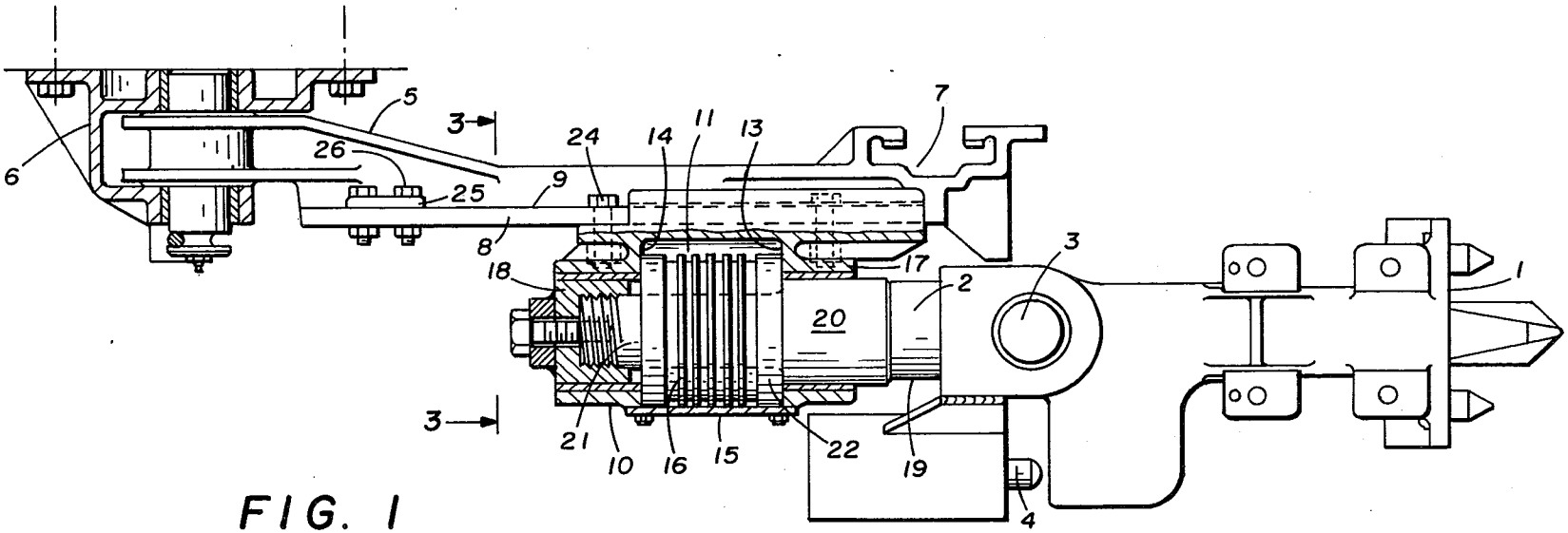
FIG. 1 is a side elevation view, partly in cross section, of a preferred embodiment of the draft gear rigging of the present invention.

In accordance with the present invention, there is provided a draft rigging for a railway car. The rigging comprises a longitudinally extending drawbar having a lower beam member with an upper bearing surface. A housing, having a pocket for containing a cushioning means, is disposed below the beam member. The housing contains means thereabove for slidably engaging the bearing surface of the beam member.

The housing is releasably secured to the beam member with a shear means, preferably frangible bolts or pins passing through the beam member and housing. The beam member may also contain additional shear means disposed on the bearing surface rearward of the housing.

Referring now to the drawings in which like referenced characters designate like parts, the improved draft rigging of the present invention, while otherwise usable, probably will find its principal use in subway and like cars. It, therefore, is a draft rigging for such a car that has been illustrated as exemplary of the invention.

The illustrated draft rigging is comprised of an automatic subway-type coupler 1 such as is illustrated in U.S. Pat. No. 3,181,708, issued May 4, 1965, and assigned to the assignee of the present invention, which is adapted to interlock against relative movement with a mating coupler. The coupler 1 is connected for relative vertical swinging to a yoke 2 by a horizontal pivot pin 3 and is yieldably held at coupling height by a spring-pressed plunger 4 depending from the yoke. A drawbar 5 is pivoted at the rear on an anchor member 6 for horizontal swinging. The anchor member 6 is attached to the underframe (not shown) of the subway or like car (not shown). The drawbar is supported at the front on the usual radial carrier bar (not shown) which it receives in slot 7.

The drawbar 5 has a lower beam member 8 with an upper bearing surface 9. A portion of the drawbar is inverted T-shaped in cross section while the front and rear portions have upper flared surfaces to accomodate the slot 7 and attachment means to the anchor member 6.

Disposed below the drawbar is a housing 10 containing a pocket 11 open at the bottom. It is bounded at the sides by laterally spaced sidewalls 12 and at the front and rear by longitudinally spaced front and rear walls 13 and 14 respectively. Substantially rectangular in cross section, the pocket 11 is closed at the bottom by a cover or closure plate 15 bolted or otherwise fixed to the housing. Housed or contained in the pocket 11 is a rubber or other cushioning unit 16 suitable for cushioning the draft and normal or ordinary buffing forces transmitted to it from coupler 1 through the yoke 2.

The yoke 2 is slidably mounted in the housing 10 for relative longitudinal movement or telescoping in longitudinally spaced, preferably lined or bushed front and rear bearings 17 and 18, respectively. The front bearing 17 is fixed against relative movement to the housing 10 and may be rigid or as illustrated, integral with the front wall 13 of the housing and projects forwardly from the pocket 11. The rear bearing 18 is rigid within the back wall 14 and projects rearward from the pocket 11, with a normally fixed backing for the cushioning unit 16 under normal buffing forces. The yoke 2 has a stem 19 which extends through the front and rear bearings 17 and 18 and the intervening cushioning unit 16. For stability without curtailment of the effective area of the illustrated cushioning unit 16, the yoke stem 19 has sliding in the front bearing 17 a cylindrical boss 20 and, rearwardly therefrom is a reduced diameter or neck section which passes through the cushioning unit 16 and terminates with a threaded portion and receives a cylindrical collar or sleeve secured against loosening by a set bolt. Mounted on the cylindrical neck section and concentric with but of greater cross section than boss 20 and collar or sleeve 21, the cushioning unit 16 is compressed in draft between the collar 21 and the front wall 13 and in buff between the boss 20 and the rear wall 14.

Contained in the rear part of the pocket 11, the illustrated rear wall 14 is of rectangular cross section and flat faced to conform to and engage the sides of that part adjacent the pocket containing the draft gear 16. In prior art constructions, the yoke and cushioning unit were housed within the drawbar itself and the cushioning unit was backed up by a shear block which was secured to the housing by frangible means that would release under a prescribed buffing force and allow the coupler yoke and cushioning unit to slide rearwardly toward and as far as the rear wall and bearing block. It was the addition of this increment to the telescoping or rearward travel of the yoke into the drawbar, normally permitted by the compressability of the cushioning unit that was responsible for relieving the draft riggings and underframes of connected cars from abnormal buffing forces and transmitting them instead directly between the car bodies (not shown), usually through anti-climbers at their adjourning ends.

Figure 3:
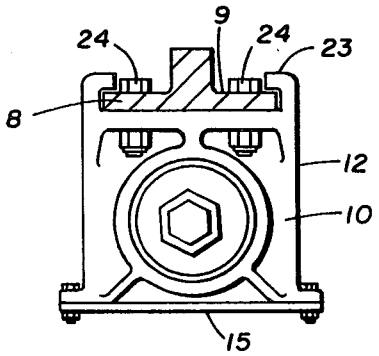
FIG. 3 is a rear elevation view, partly in cross section, of a portion of the structure taken along lines 3—3 of FIG. 1.
Figure 2:
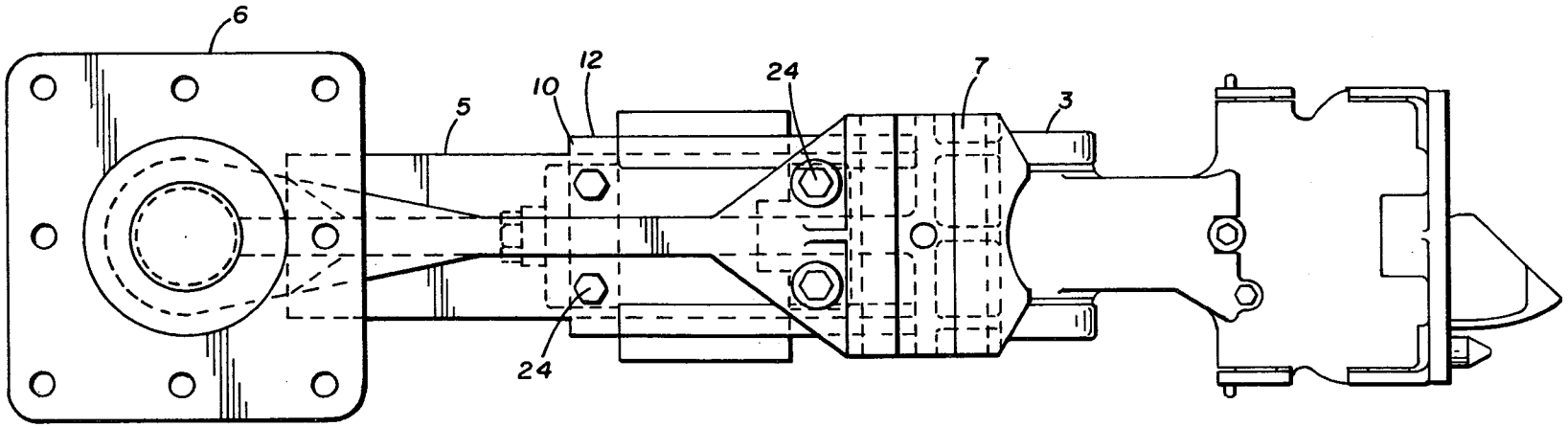
FIG. 2 is a plan view of the structure of FIG. 1.

The improvement according to the present invention, as best shown in FIG. 3, consists of a housing 10 for the cushioning unit 16 and associated yoke 2 and coupler 1 mounted below the beam 8 of the drawbar 5. The sidewalls 12 of the housing 10 extend upwardly and terminate with inwardly extending flanges or lugs 23 which mate, on both sides of the beam 8, with the bearing surfaces 9. This permits a sliding relationship of the housing with respect to the beam in the rearward direction. The housing 10 is secured to the beam 8 by frangible shear bolts or pins 24 which pass through the bearing surface of the beam and the top surface of the housing. The bolts or pins are adapted to shear at a predetermined force in the event of a collision and when this occurs, the housing, yoke and coupler slide rearwardly along the beam a sufficiently long distance to prevent damage caused by an accident that deforms the end of the car. As an additional measure of protection for the coupler-yoke assembly, a shear plate 25 extending across the bearing surface 9 of the beam 8 may be secured at a rearward position thereon with shear bolts or pins 26 similar to the bolts 24.

From the above-detailed description it will be apparent that there has been provided an improved shaft rigging which not only will release for protecting itself and the underframe from abnormal buffing forces, but is readily restorable to the initial condition by merely replaceing the shear bolts. It should be understood that the described and disclosed embodiment is merely exemplary of the invention and that all modifications are intended to be included that do not depart from the spirit of the invention and the scope of the appended claims.

Having thus described the invention in detail and with sufficient particularity as to enable those skilled in the art to practice it, what is desired to have protected by Letters Patent is set forth in the following claims.

We claim:

1. In a draft rigging for a railway car, a longitudinally extending drawbar having a lower beam member with an upper bearing surface, a housing having a pocket for containing a cushioning means disposed below the beam member, the housing having means thereabove for slidably engaging the bearing surface of the beam member, the housing containing cushioning means within the pocket and a yoke passing through the cushioning means and extending forwardly from the housing, the yoke being pivotally connected to a coupler.

2. The rigging of claim 1, in which the housing is releasably secured to the beam member with shear means.

3. The rigging of claim 2, in which the shear means are bolts or pins passing through the beam member and housing.

4. The rigging of claim 2, in which the beam member contains additional shear means disposed on the bearing surface rearward of the housing.

5. The rigging of claim 1, in which the housing contains outer, upwardly extending sidewalls having inwardly extending flanges for slidably engaging the beam member.

6. The rigging of claim 1, in which a portion of the drawbar is an inverted T in cross section.

7. A draft rigging for a railway car comprising a drawbar having a forward and rearward end and a lower beam member with an upper bearing surface, a housing having a pocket containing cushioning means disposed near the forward end of the drawbar and below the beam member, the housing having means thereabove for slidably engaging the bearing surface of the beam member, said housing being releasably secured to the beam member with shear means, a yoke passing through the cushioning means within the pocket and extending forwardly from the housing and a coupler pivotally connected to the yoke.

8. The rigging of claim 7, in which the rearward end of the drawbar is pivotally connected to an anchor member.

* * * * *